US006350131B1

(12) United States Patent
Shih

(10) Patent No.: US 6,350,131 B1
(45) Date of Patent: Feb. 26, 2002

(54) ELECTRICAL CONNECTOR EFFECTIVELY PROTECTING AND PRECISELY POSITIONING TERMINALS THEREIN

(75) Inventor: Yueh-Shan Shih, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/665,573

(22) Filed: Sep. 19, 2000

(30) Foreign Application Priority Data

May 30, 2000 (TW) ..... 89209212 U

(51) Int. Cl.[7] ..... H01R 12/16
(52) U.S. Cl. ..... 439/65; 439/654; 439/650
(58) Field of Search ..... 439/79, 650, 654, 439/686, 724, 723, 65, 74

(56) References Cited

U.S. PATENT DOCUMENTS 4,781,625 A * 11/1988 Yang ..... 439/724
5,037,332 A * 8/1991 Wilson ..... 439/654
5,584,709 A * 12/1996 Kiat ..... 439/79

* cited by examiner

*Primary Examiner*—Gary F. Paumen
(74) *Attorney, Agent, or Firm*—Wei Te Chung

(57) ABSTRACT

An electrical connector according to the present invention includes an insulative housing (10) defining two rows of passageways (101) therethrough, a spacer (30) attached to the bottom of the housing, and a plurality of first and second terminals (11, 12). The spacer defines two rows of passageways (301) therethrough, corresponding to the two rows of passageways within the housing. Each first and each second terminal is bent at a right angle at a middle portion thereof, and such terminals are respectively received in each of the two rows of passageways of both the housing and spacer. Each first and each second terminal includes an upper contact portion (111, 121), a lower contact portion (112, 122) and a connecting plate (110, 120) formed between the upper and the lower contact portions. Each upper and lower contact portion respectively includes a pair of contact strips (111, 121, 112, 122) facing each other, for resiliently engaging with terminals of exterior devices (5, 2). The housing has a pair of locking blocks (102) at opposite ends thereof. The spacer has a pair of projections (302) extending outwardly from opposite ends thereof, for latching with the locking blocks of the housing.

1 Claim, 9 Drawing Sheets

ELECTRICAL CONNECTOR EFFECTIVELY PROTECTING AND PRECISELY POSITIONING TERMINALS THEREIN

FIELD OF THE INVENTION

The present invention relates to an electrical connector, and in particular to an electrical connector with precisely positioned terminals for connecting more than one device together.

BACKGROUND OF THE INVENTION

A variety of electrical connectors are used for interconnecting multiple devices to transmit signals therebetween. A conventional connector is illustrated in U.S. Pat. No. 5,584,709. As shown in FIG. 7, an electrical connector 10 comprises a housing 12 retaining a plurality of first and second terminals 30*a*, 30*b* therein. The terminals 30 have terminating portions 54 rearwardly extending beyond the housing 12. A solder leg 60 extends perpendicularly from an end of the terminating portion 54 and through a corresponding hole 70 in a printed circuit board (PCB).

The terminal portions 54 are exposed to damage outside of the housing 12. The positions of the solder legs 60 of the terminals 30 is not precisely controlled, making accurate placement of soldered connections of the terminals 30 with the PCB unpredictable. Furthermore, the terminals 30 are poorly supported, resulting in a weak structure.

BRIEF SUMMARY OF THE INVENTION

A main object of the present invention is to provide an electrical connector which reliably positions and protects terminals therein.

Another object of the present invention is to provide an electrical connector which provides support to its terminals, thereby enhancing their strength.

An electrical connector according to the present invention includes an insulative housing defining two rows of passageways therethrough, a spacer attached to the bottom of the housing, and a plurality of first and second terminals. The spacer defines two rows of passageways therethrough, corresponding to the two rows of passageways within the housing. Each first and each second terminal is bent at a right angle at a middle portion thereof, and such terminals are respectively received in each of the two rows of passageways of both the housing and spacer. Each terminal includes an upper contact portion, a lower contact portion, and a connecting plate formed between the upper and the lower contact portions. Each upper and lower contact portion respectively includes a pair of contact strips facing each other, for resiliently engaging with terminals of external devices. The housing has a pair of locking blocks at opposite ends thereof. The spacer has a pair of projections extending outwardly from opposite ends thereof, for latching with the locking blocks of the housing.

Other objects, advantages and novel features of the invention will become more apparent from the following detailed description when taken in conjunction with the accompanying drawings.

DETAILED DESCRIPTION OF INVENTION

Figure 1A:
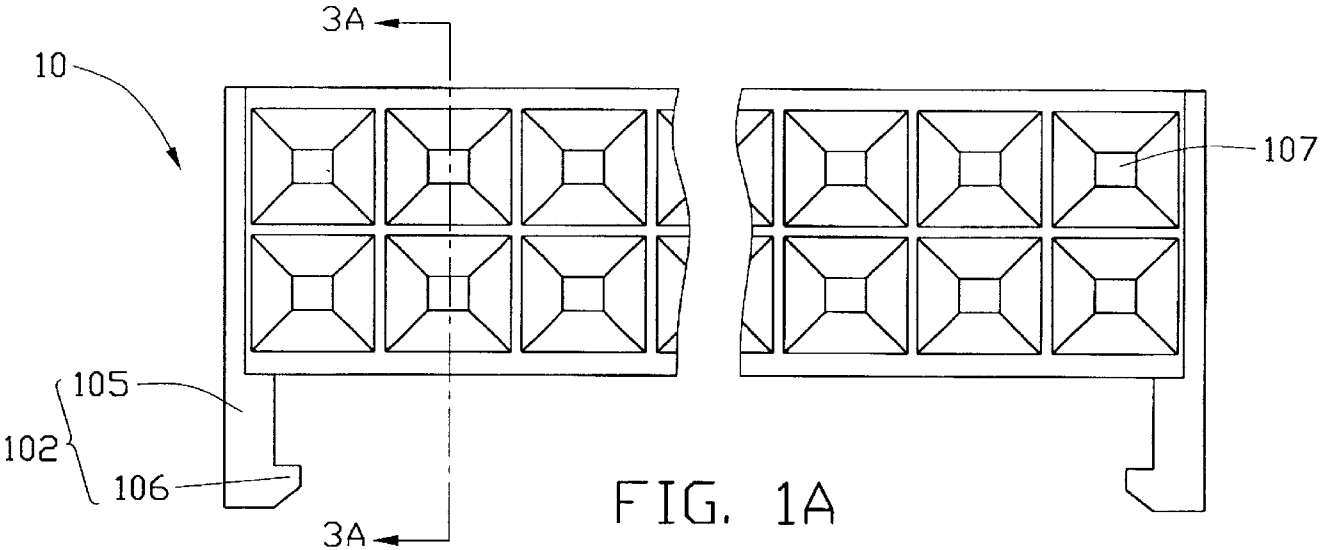
FIG. 1A is an abbreviated front view of a housing of an electrical connector in accordance with the present invention.

Referring to the drawings and particularly to FIGS. 1A, 1B, 2A and 5, an electrical connector according to the present invention comprises an insulative housing 10, a plurality of first and second terminals 11, 12 for being received in the housing 10, and a spacer 30 for positioning the terminals 11, 12.

Figure 3A:
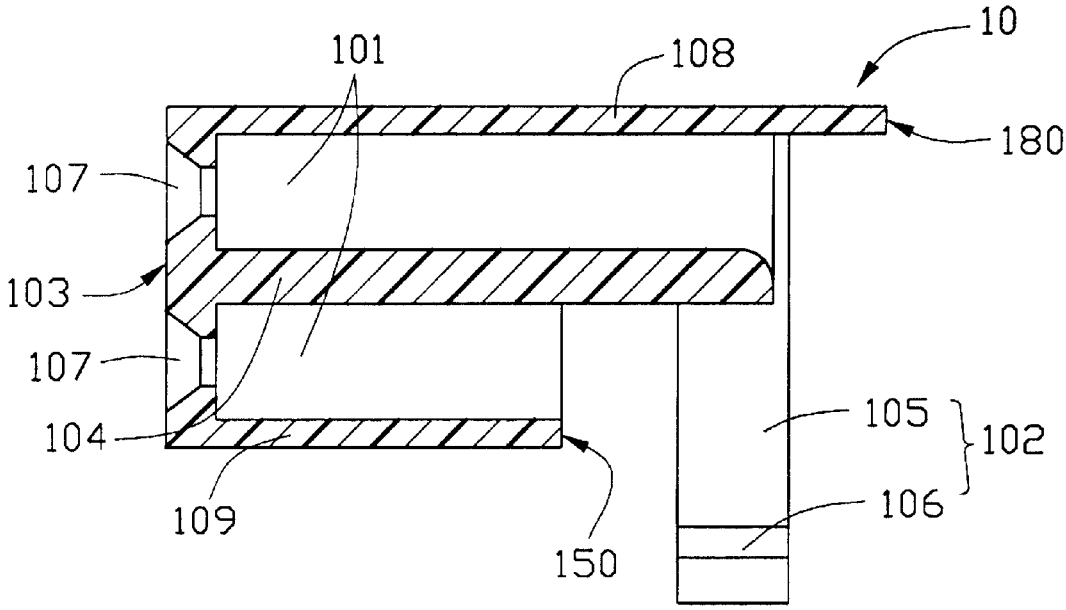
FIG. 3A is a cross-sectional view of the housing taken along line 3A—3A of FIG. 1A.

Referring particularly to FIG. 3A, the housing 10 has an elongate configuration, with a first mating surface 103 defining a plurality of substantially rectangular openings 107. Each opening 107 gradually decreases in width from the first mating surface 103 toward the interior of the housing 10. The openings 107 are equidistantly arrayed in two rows for guiding complementary terminals 50 of a first mating device 5 (see FIG. 6). A plurality of elongate passageways 101 is defined in the housing 10, each extending perpendicular to the first mating surface 103. The passageways 101 are in communication with their corresponding openings 107, for respectively receiving corresponding first and second terminals 11, 12. A first side wall 108 of the housing 10 is substantially longer than a second side wall 109, and a separating wall 104 between the first and second side walls 108, 109 separates adjacent passageways 101. The passageways 101 in a first upper row between the first side wall 108 and the separating wall 104 are deeper than the passageways 101 in a second lower row between the second side wall 109 and the separating wall 104.

Figure 4:
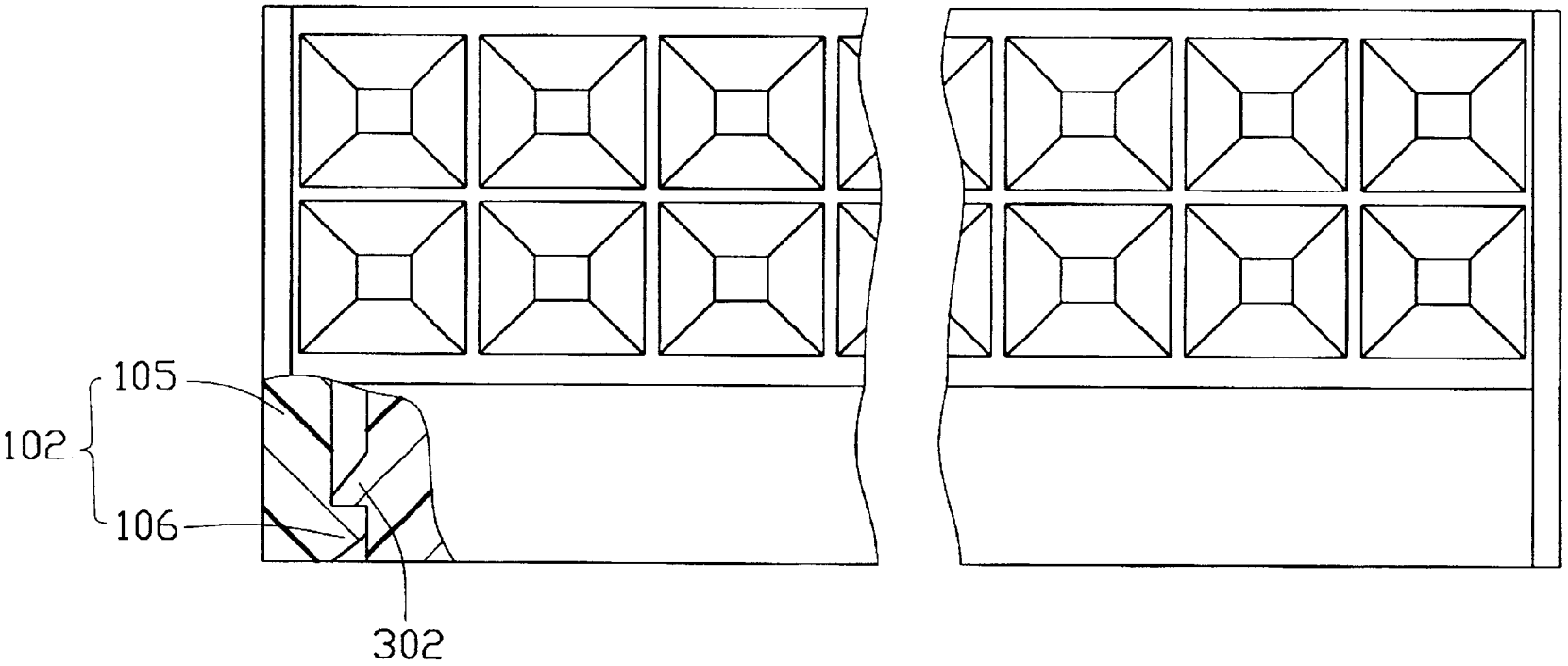
FIG. 4 is an abbreviated front view of the electrical connector when assembled, partially cut away to show engagement of a locking block of the housing with a projection of the spacer.

Referring particularly to FIGS. 3A and 4, a pair of locking blocks 102 is respectively formed at opposite ends of the housing 10. Each locking block 102 includes a beam 105 depending perpendicularly from an end of the first side wall 108, and a hook 106 extending perpendicularly inwardly from a lower end of the beam 105.

Figure 3B:
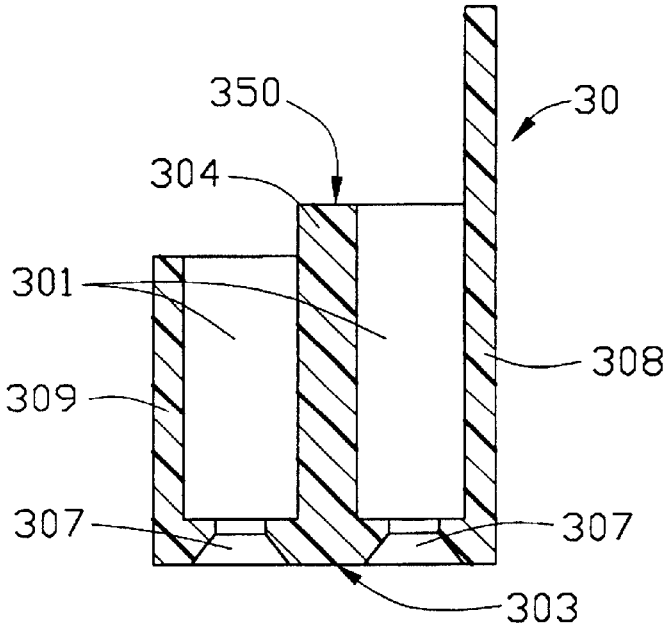
FIG. 3B is a cross-sectional view of the spacer taken along line 3B—3B of FIG. 1B.

Referring particularly to FIG. 3B, the spacer 30 has an elongate configuration, with a second mating surface 303 defining a plurality of substantially rectangular openings 307. Each opening 307 gradually decreases in width from the second mating surface 303 toward the interior of the spacer 30. The openings 307 are equidistantly arrayed in two rows for mating with complementary corresponding terminals 20 of a second mating device 2 (see FIG. 6). A plurality of elongate passageways 301 is defined in the spacer 30, each extending perpendicular to the second mating surface 303. The passageways 301 are in communication with their corresponding openings 307, for respectively receiving corresponding first and second terminals 11, 12. A first side wall 308 of the spacer 30 is substantially longer than a second side wall 309, and a separating wall 304 between the first and second side walls 308, 309 separates adjacent passageways 301. The passageways 301 in a first rear row between the first side wall 308 and the separating wall 304 are deeper than the passageways 301 in a second front row between the second side wall 309 and the separating wall 304.

Figure 1B:
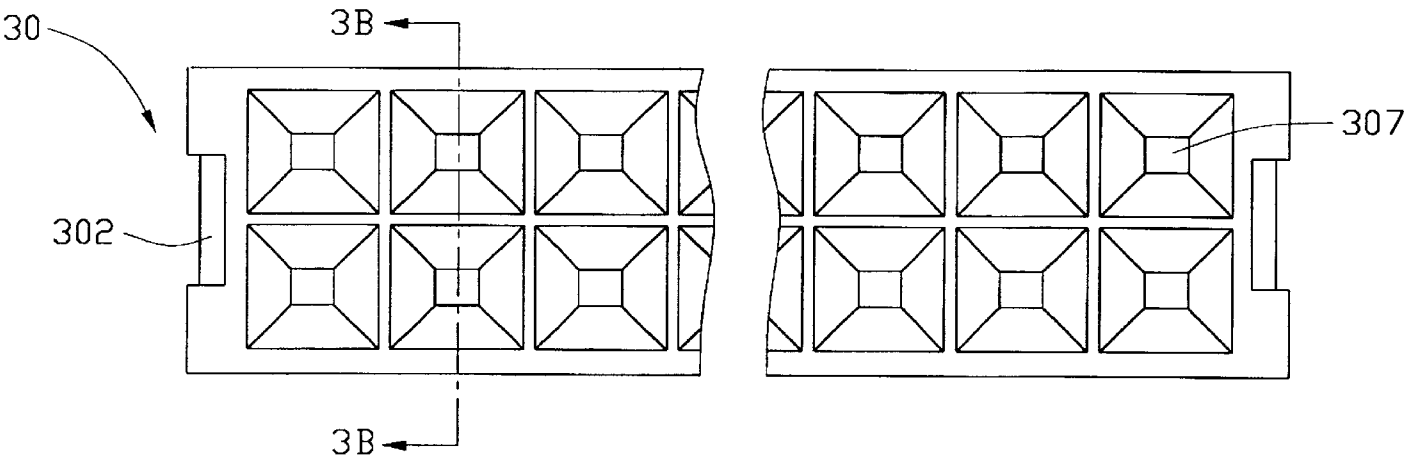
FIG. 1B is a bottom view of a spacer of an electrical connector in accordance with the present invention.

Referring particularly to FIGS. 1B and 4, a pair of projections 302 is respectively formed at opposite ends of the spacer 30, for latching with corresponding locking blocks 102 on the housing 10.

Figure 2A:
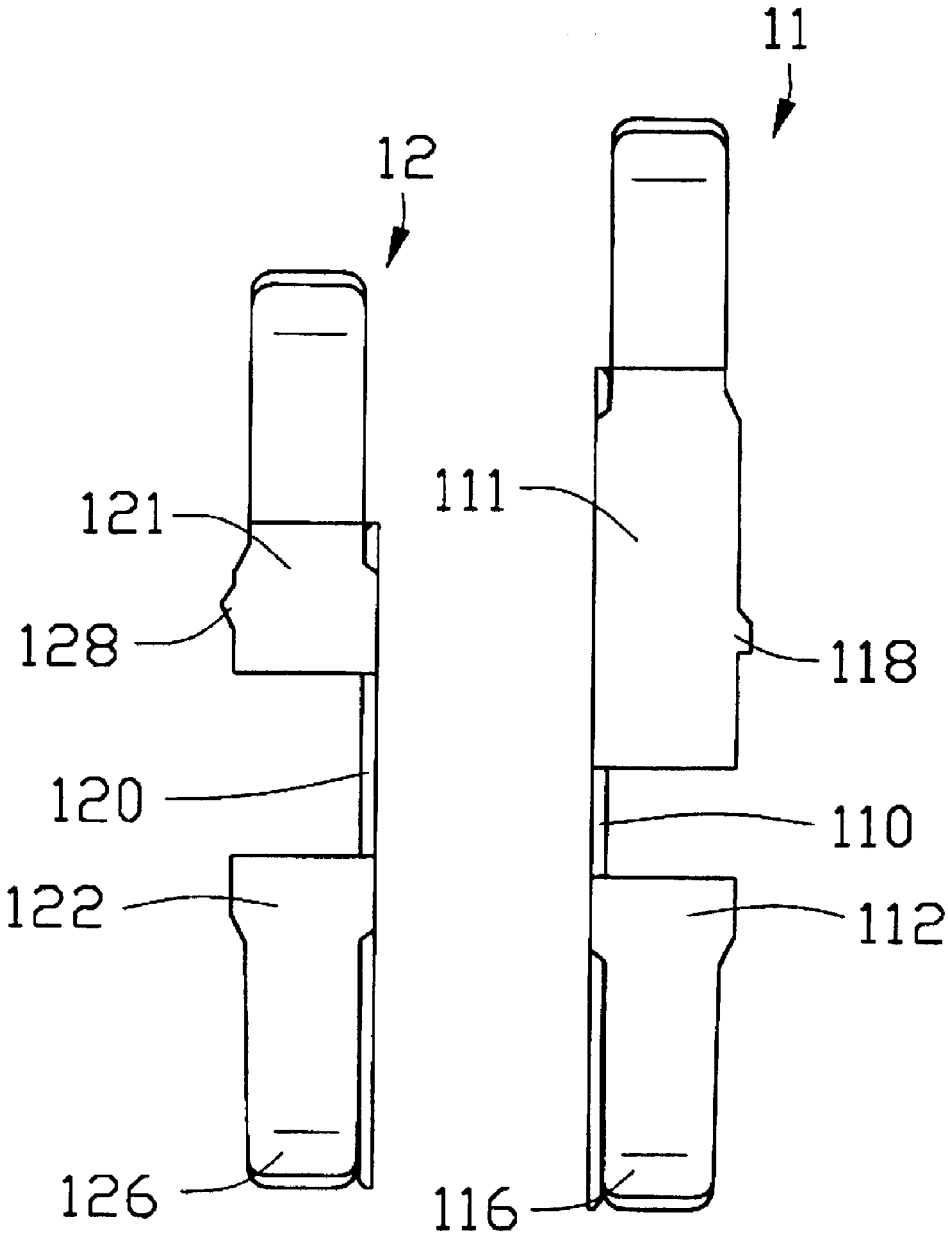
FIG. 2A is a side view of an unbent first terminal and an unbent second terminal of an electrical connector of the present invention, prior to the terminals being bent and assembled into the housing and the spacer.
Figure 2B:
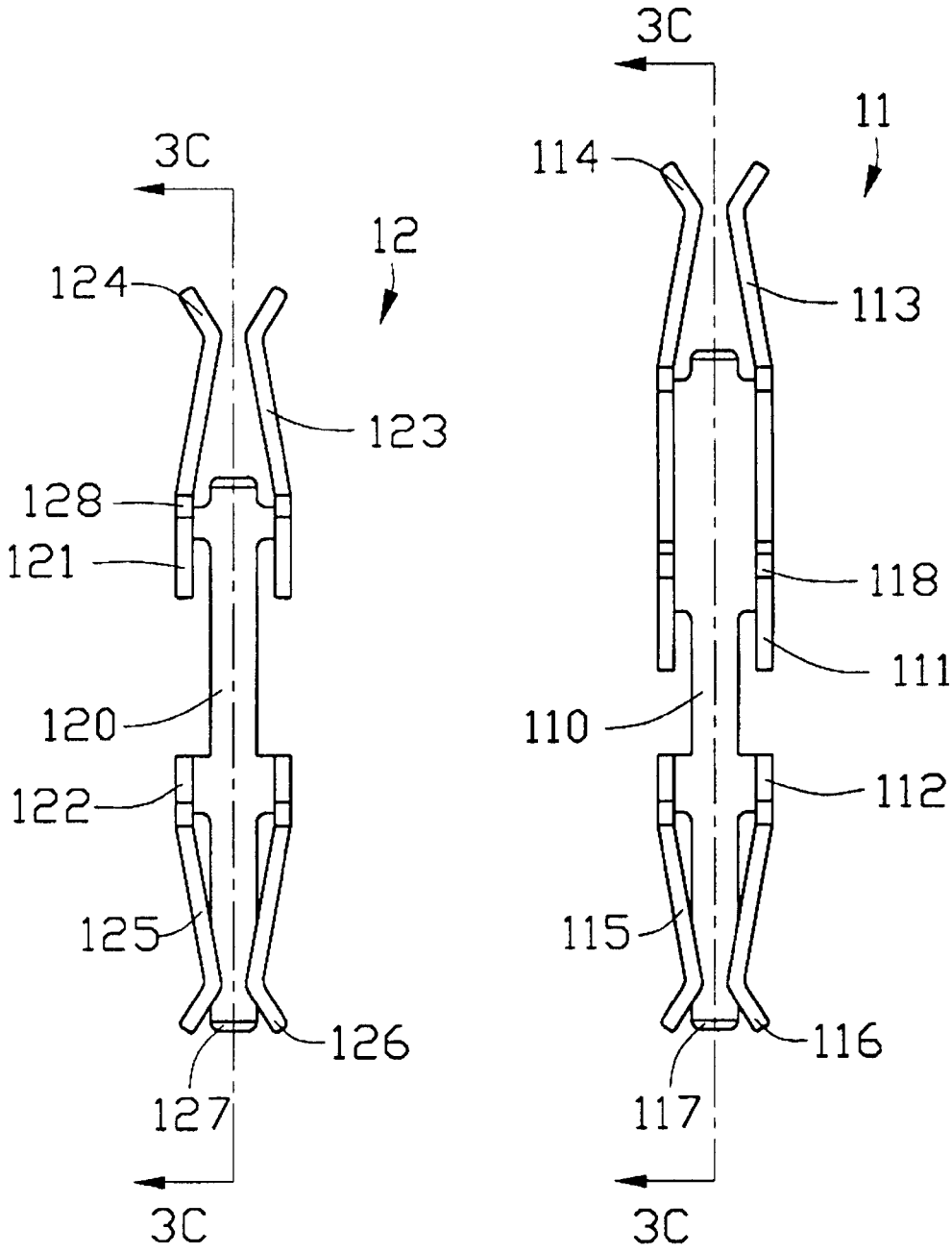
FIG. 2B is a front view of each of the unbent first and second terminals of FIG. 2A.

Referring particularly to FIGS. 2A, 2B and 3A, each first and second terminal 11, 12 respectively comprises an elongate first and second connecting plate 110, 120, each having respectively a pair of first and second upper contact strips 111, 121 and a pair of first and second lower contact strips 112, 122 extending from the respective first and second connecting plates 110, 120. Each pair of first and second upper contact strips 111, 121 and each pair of first and second lower contact strips 112, 122 extends from opposite lateral edges of, respectively, an upper portion (not labeled) and a lower portion (not labeled) of the respective first and second plates 110, 120. Each first and second upper contact strip 111, 121 and each first and second lower contact strip 112, 122 is perpendicular to the plane of the respective connecting plate 110, 120, and each includes an arm 113, 115, 123, 125 bending first inwardly toward a paired arm 113, 115, 123, 125 and then outwardly away from the paired arm 113, 115, 123, 125. A narrow space (not labeled) is thus formed between the inward most points of the arms 113, 123 of each pair of first and second upper contact strips 111, 121 for insertion of a complementary terminal 50 of a first mating device 5 (see FIG. 6). Likewise, a narrow space (not labeled) is formed between the inward most points of the arms 115, 125 of each pair of first and second lower contact strips 112, 122 for insertion of a complementary terminal 20 of a second mating device 2 (see FIG. 6). Each arm 113, 115, 123, 125 respectively ends in a distal upper and lower tip 114, 116, 124, 126. A barb 118, 128 is formed at an outer edge of each first and second upper contact strip 111, 121 for engaging respectively with an inner surface of the first and second side walls 108, 109 of the housing 10.

Figure 3C:
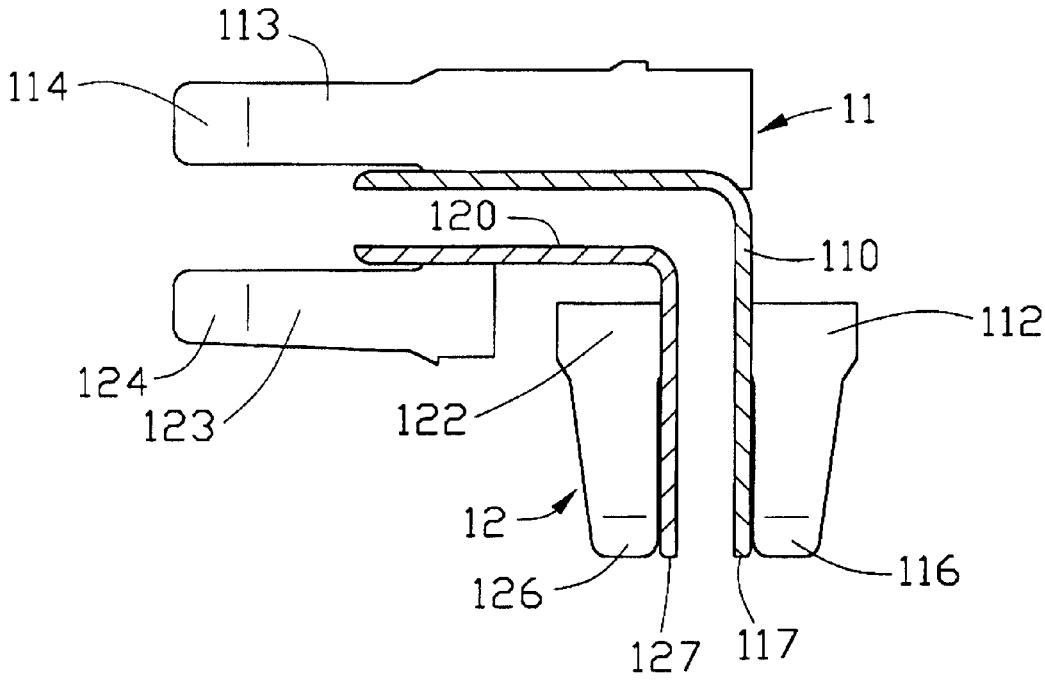
FIG. 3C is a cross-sectional view taken along line 3C—3C of each of the first terminal and second terminal of FIG. 2B, wherein both terminals are now bent at right angles.

Referring particularly to FIG. 3C, prior to assembly, the first and second terminals 11, 12 are bent at right angles at a middle portion of the first and second connecting plates 110, 120.

Figure 5:
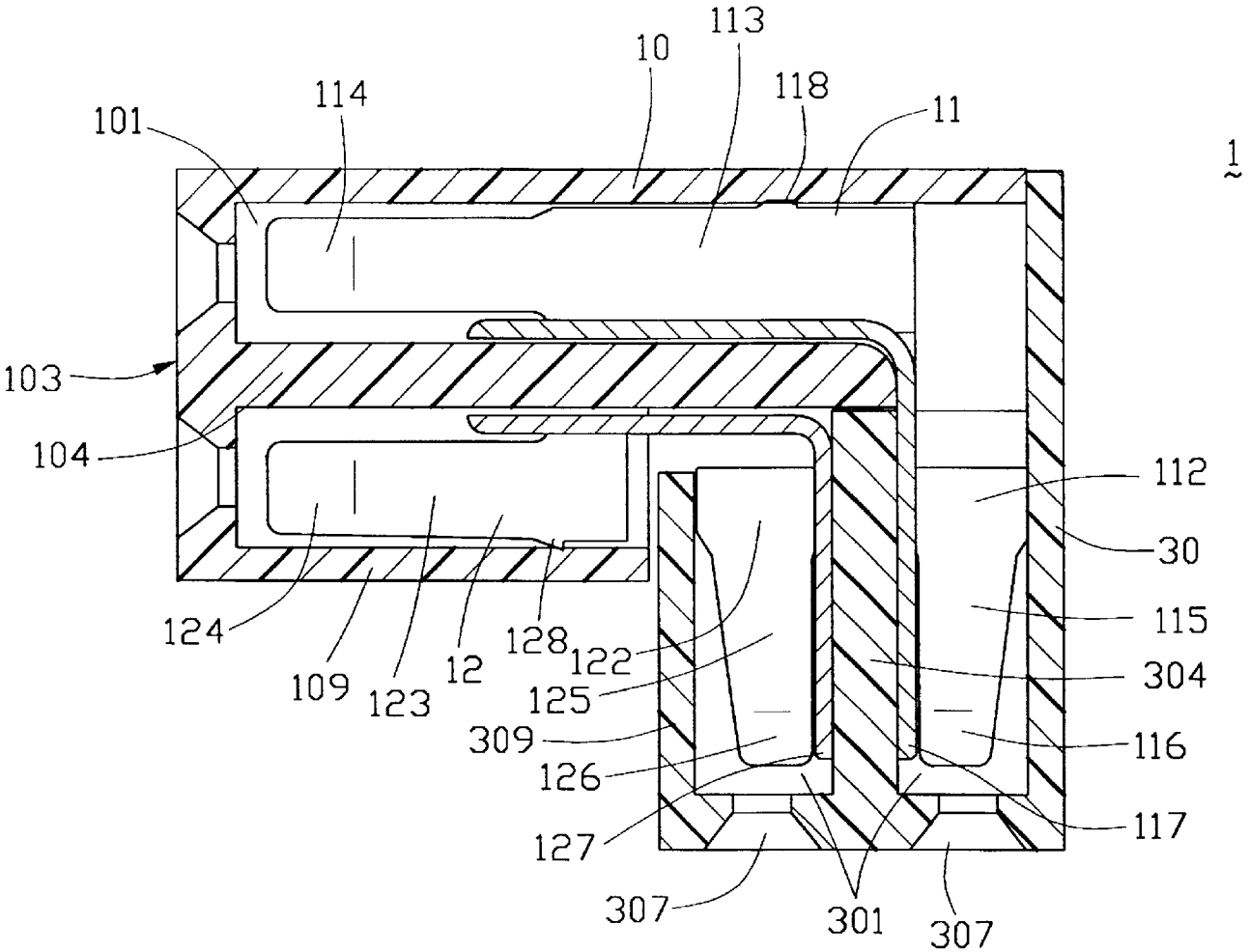
FIG. 5 is a cross-sectional view of the assembled electrical connector.
Figure 6:
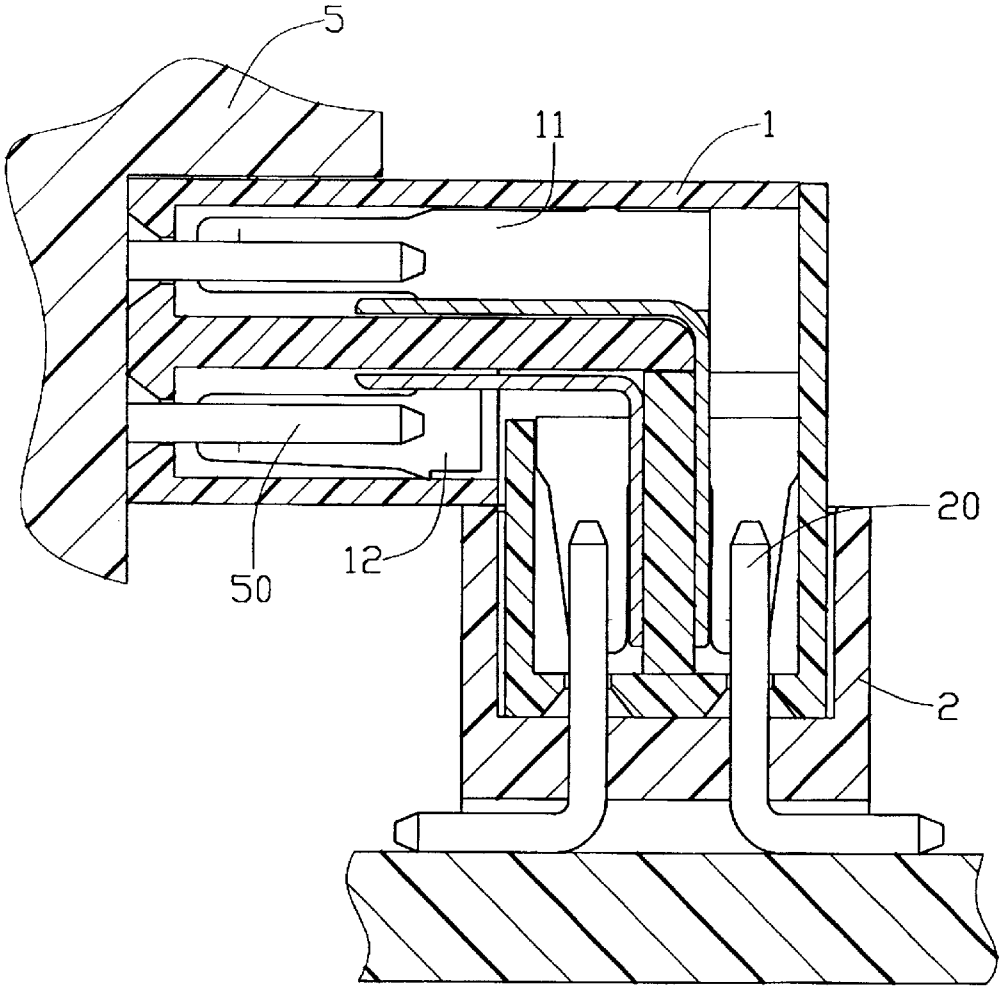
FIG. 6 is similar to FIG. 5, but showing the electrical connector engaged with external devices.
Figure 7:
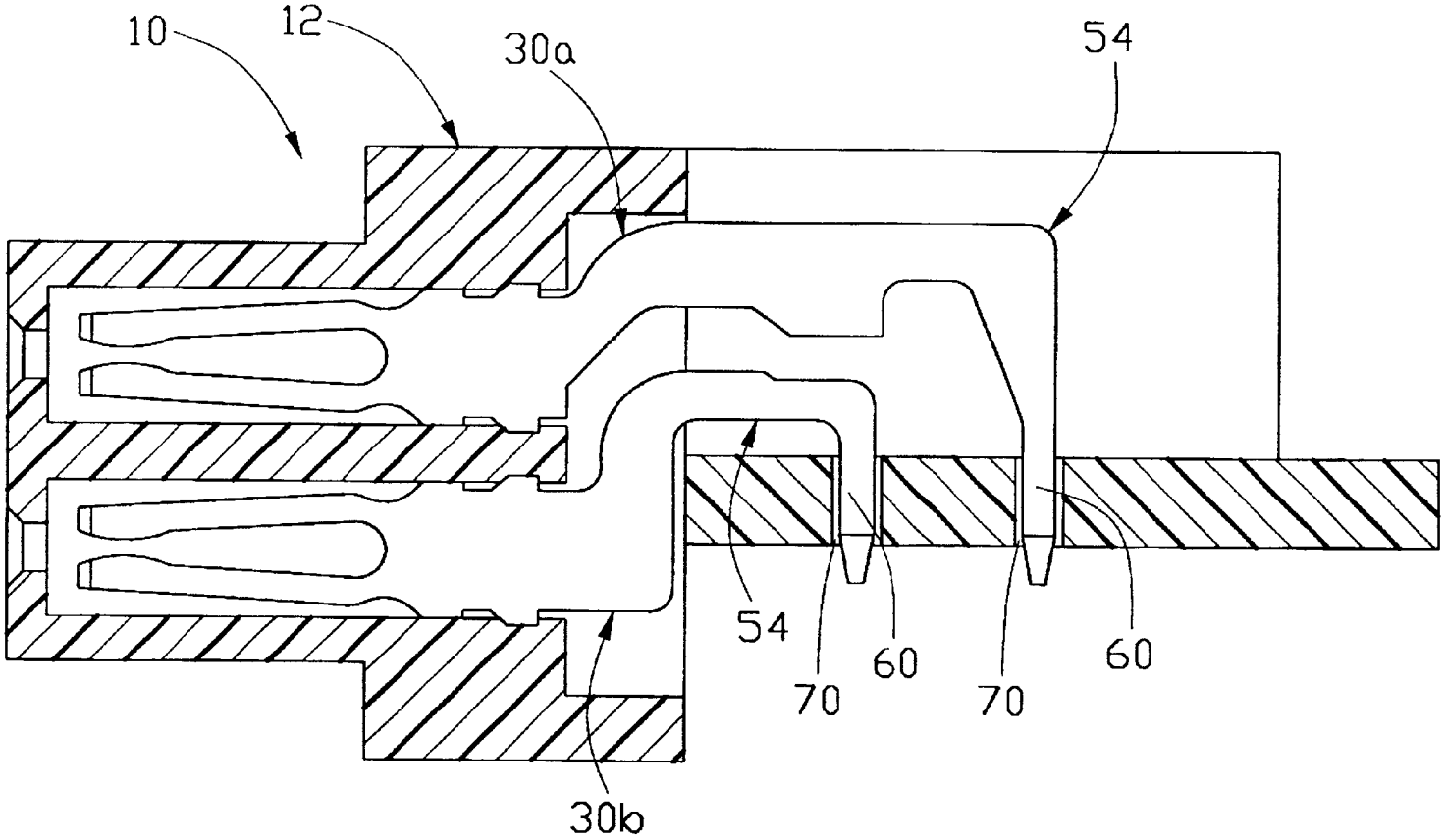
FIG. 7 (PRIOR ART)
FIG. 7 is a cross-sectional view of a conventional electrical connector.

In assembly, referring particularly to FIGS. 4, 5 and 6, the first and second terminals 11, 12 are inserted into the spacer 30. Each first and second connecting plate 110, 120 of the first and second terminals 11, 12 has aback surface (not labeled) respectively abutting opposite sides of the separating wall 304 of the spacer 30. Lower tips 116, 126 of the first and second lower contact strips 112, 122 are coplanar with lower tips 117, 127 of the first and second connecting plates 110, 120, and are respectively inserted into first rear row and second front row passageways 301 of the spacer 30.

The first and second upper contact strips 111, 121 of the first and the second terminals 11, 12 respectively are inserted into the first upper row and second lower row passageways 101 of the housing 10. Each first and second connecting plate 110, 120 of the first and the second terminals 11, 12 has the back surface (not labeled) respectively abutting opposite sides of the separating wall 104 of the housing 10. The second side wall 109 of the housing 10 has a rear edge 150 (see FIG. 3A) pressing against an outer surface of the second side wall 309 of the spacer 30. The separating wall 304 of the spacer 30 has a top edge 350 (see FIG. 3B) abutting against a lower surface of the separating wall 104 of the housing 10. The first side wall 108 of the housing 10 has an end edge 180 (see FIG. 3A) pressing against an inner surface of the first side wall 308 of the spacer 30. The barbs 118, 128 of the first and second terminals 11, 12 engage with interior surfaces of the first and second side walls 108, 109, respectively, of the housing 10. The locking blocks 102 of the housing 10 latch with the corresponding projections 302 of the spacer 30. Each projection 302 has a side surface abutting the beam 105 of a corresponding locking block 102, and a lower surface abutting the hook 106 of the corresponding locking block 102 (see FIG. 4).

Therefore, the housing 10 and the spacer 30 are firmly attached together, with the terminals 11, 12 being fixedly retained therein. The terminals 11, 12 are reliably positioned and well supported within the housing 10 and spacer 30, making connections with complementary terminals 50 and 20 (see FIG. 6) more reliable, and increasing the working lifetime of the terminals 11, 12.

Referring particularly to FIGS. 3A, 3B, 5 and 6, complementary terminals 50 of the first mating device 5 extend from the first mating surface 103 through the openings 107 into the passageways 101. Complementary terminals 20 of the second mating device 2 extend from the second mating surface 303, through the openings 307 and into the passageways 301. The retention of the terminals 11, 12 in the spacer 30 effectively protects the terminals 11, 12 and makes connection between the connector 1 and the second mating device 2 more reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted to electrically engage with external devices, comprising:

an insulative housing defining a plurality of passageways therethrough;

a spacer attached to the housing and defining a plurality of passageways therethrough corresponding to the plurality of passageways of the housing; and a plurality of first and second female terminals received in corresponding passageways of the housing and the spacer, each first and second terminal including, respectively, first and second upper contact portions, first and second lower contact portions and first and second connecting plates formed between the first and second upper contact portions and the first and second lower contact portions, the first and second upper contact portions and the first and second lower contact portions being respectively adapted to engage with external devices;

wherein the passageways of the housing are arrayed in two rows, thereby forming a first side wall, a second side wall substantially shorter than the first side wall, and a separating wall between the first and second side walls separating adjacent passageways, whereby the passageways in a first upper row between the first side wall and the separating wall are deeper than the passageways in a second lower row between the second side wall and the separating wall for respectively receiving the corresponding first and second terminals;

wherein a plurality of barbs is provided at an outer edge of each first and second upper contact strip portion, for engaging respectively with inner surfaces of the first and second side walls of the housing;

wherein a pair of locking blocks is respectively formed at opposite ends of the housing;

wherein each locking block includes a beam depending perpendicularly from an end of the housing;

wherein a hook extends and bends perpendicularly inwardly from a lower end of each beam;

wherein a pair of projections is respectively formed at opposite ends of the spacer, for latching with the locking blocks of the housing.

* * * * *